US006250997B1

(12) United States Patent
Hatano et al.

(10) Patent No.: US 6,250,997 B1
(45) Date of Patent: Jun. 26, 2001

(54) PROCESSING MACHINE

(75) Inventors: Kazutomo Hatano; Mitsuru Maruya, both of Ayase (JP)

(73) Assignee: Speedfam-Ipec Co LTD, Kanagawa (JP)

( * ) Notice: Subject to any disclaimer, the term of this patent is extended or adjusted under 35 U.S.C. 154(b) by 0 days.

(21) Appl. No.: 09/427,069

(22) Filed: Oct. 26, 1999

(30) Foreign Application Priority Data

Oct. 27, 1998 (JP) ..... 10-305403

(51) Int. Cl.[7] ..... B24B 7/00
(52) U.S. Cl. ..... 451/259; 451/268; 451/269
(58) Field of Search ..... 451/41, 64, 63, 451/259, 268, 269, 270, 285, 287, 288, 398

(56) References Cited

U.S. PATENT DOCUMENTS 5,197,230 * 3/1993 Simpfendorfer et al. ..... 451/446
5,554,064 * 9/1996 Breivogel et al. ..... 451/60
5,593,344 * 1/1997 Weldon et al. ..... 451/296
5,791,976 * 8/1998 Honda ..... 451/60
6,004,187 * 12/1999 Nyui et al. ..... 451/5
6,093,081 * 7/2000 Nyui et al. ..... 451/6

FOREIGN PATENT DOCUMENTS

23845 * 12/1899 (GB) ..... 451/60

* cited by examiner

*Primary Examiner*—Derris H. Banks

(57) ABSTRACT

A lapping or polishing machine which processes the surface of silicon wafer or other work piece by rotating a platen with constant supply of lapping or polishing compound. Said platen of the lapping or polishing machine is connected directly to a direct drive motor and driven by the direct drive motor, and the point to point control of said platen is carried out by a rotary encoder.

6 Claims, 2 Drawing Sheets

PROCESSING MACHINE

BACKGROUND OF THE INVENTION

1. Field of the Invention

Figure 1:
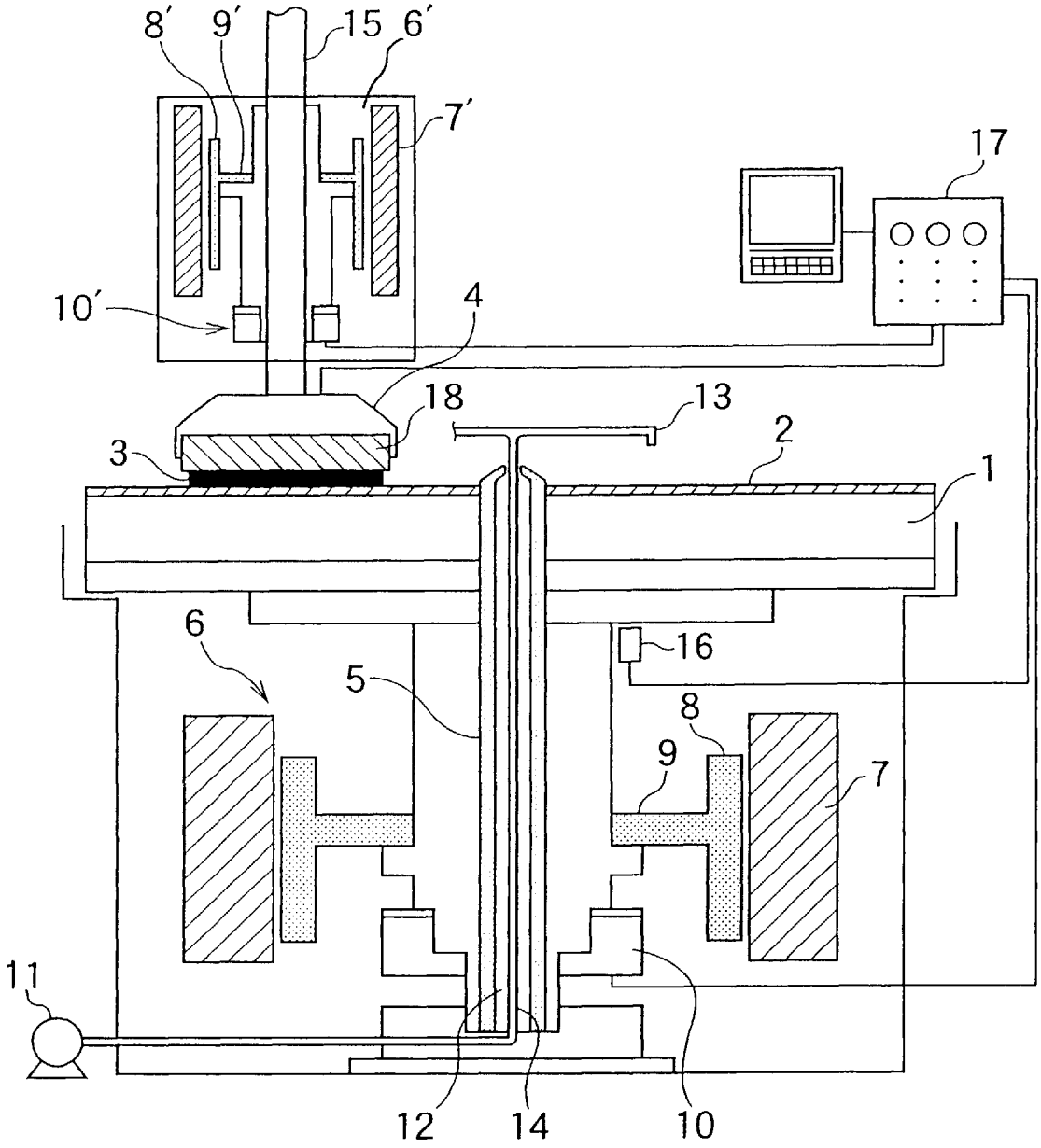

The present invention relates to a processing machine, such as grinding machine, lapping machine or polishing machine, useful for the processing of a surface of a plate type work-piece, e.g. silicon wafer, to which very precise flatness; parallelism and surface roughness are required. In move in detail, the present invention relates to the driving mechanism which drives the platen of the processing machine.

2. Description of the Prior Art

Lapping or polishing to obtain excellent surface precision and surface roughness on the plate type of work piece to which precise flatness and parallelism are required, has been accomplished using the following method. That is, a work piece is pressed to a rotatable platen of lapping or polishing machine, then lapped or polished by a rotating action of the work piece and platen under the constant supply of compound for lapping or polishing containing abrasives, and the surface roughness of the work piece is improved.

Recently, the requirements to improve the machining accuracy and the dimensional stability to a silicon wafer and a compound semiconductor wafer, which are the starting materials of integrated circuit (IC) or large-scale integration (LSI), and a magnetic disk substrate made of aluminium alloy or glass, are becoming more important. Accordingly, the requirements for the processing machine to improve the thermal stability against temperature changes, and to reduce the vibration of machine, which greatly affect the processing results, are also becoming more important, further, regarding other incidental conditions, more severe control is becoming necessary.

In general, these machines such as lapping machine, or polishing machine, have a platen of considerable thickness made of metal e.g., cast iron, copper, tin or low steel, or non metallic materials, e.g., ceramics or glass, and the platen and a work piece are rotated severally. The processing is carried out on the surface of the platen. The mechanism of these type machines is to process the surface of work piece by friction caused by rotating action of fine particles of abrasive which exist between the platen and work piece. Therefore, the rotating speed must not be effected by the change of friction force and must not cause vibration. In the case of these machines the platen is rotated by the driving motor arranged at the lower position of the housing, while, the work piece is rotated by the driving motor arranged in one or more carrier heads which are placed at the upper position of the machine. The rotating speed of each driving motor is reduced to the necessary rotating ratio by a decelerator, and conveyed to the platen by a belt or a chain.

The above mentioned method converts high speed rotation of an electric motor to low speed high torque rotation by a reduction gear, and, since the size of the decelerator is relatively big, the total size of driving mechanism containing conveying parts becomes big. Therefore, the size of machine becomes bigger and also the weight of machine becomes heavier. The place where the machine can be set up is limited, and the machine can not be considered as a handy type machine.

The above mentioned conventional machine has following problems. That is, the reduction gear will generate heat which is unique to the reduction gear, and especially in a case of high precision processing, it is necessary to prepare a shelter board made of adiabator to prevent the transmittance of generated heat to the platen, or to prepare a quenching ventilator, and these additional apparatuses encourage the tendency of large size and heavy weight of machine. Further, the effective diameter of platen is becoming bigger to meet the bigger size work piece and to satisfy the requirement to improve the productivity, and this tendency is becoming more remarkable. Furthermore, since the supplying line of lapping or polishing compound is placed on the upper position of the machine, the size of machine becomes bigger and more complicated.

Further, reduction gear type decelerator has a tendency to cause the vibration accompanied with the rotation, and by the influence of the vibration, not only surface roughness or TTV (total thickness variation) of processed surface of work piece is deteriorated, but also the problem that the accuracy of an end point detection, which detects the stock removal of work piece, is put out of order further, the trouble of causing noise is also mentioned. And, in a case of the decelerator based on mechanical mechanism, the periodical supply of lubricating oil by periodical maintenance is necessary, further the stains of machine and environment by leaked oil is mentioned as another big problem.

In a driving system which is furnished with a conventional motor, a reduction gear type decelerator and a power transmitting mean, since electric current intensity and putout, that is, load and power, are not in proportion to, each other, the positioning accuracy of a work piece on a platen before and after processing is not good, and it is pointed out as one of the big obstacles for the development of an automatic and continuous type machine. Therefore, in a conventional type machine, it is necessary to equip an additional position sensor and position corrector, which are one of the factors which make the machine complicated.

OBJECT OF THE INVENTION

The inventors of this invention have carried out an intensive study to solve above mentioned problems which characterize conventional lapping and polishing machine, and have found that the use of direct motor driving system gives good results and can solve above mentioned problems, and have accomplished the present invention. That is, the object of this invention is to provide a lapping and a polishing machine which does not generate excess heat, is small and light, has good machining accuracy and does not generate noise and stains.

BRIEF SUMMARY OF THE INVENTION

The above mentioned object can be accomplished by a lapping or polishing machine which processes the surface of a work piece stuck to a carrier head of said lapping or polishing machine by frictional force caused between the surface of a rotating platen of said lapping or polishing machine and the surface of the work piece stuck to the carrier head which is pressed to said rotating platen with supply of lapping or polishing compound, wherein said platen is connected directly to a direct drive motor and driven by said direct drive motor, and the point i.e., positioning to point control of said platen is carried out by a rotary encoder. In said lapping or polishing machine, the carrier head can be directly driven by a direct drive motor. Further, a supplying tube of lapping or polishing compound can be passed through the hollow passage duct in the center of rotating shaft of direct driving motor which drives directly the platen, and lapping or polishing compound can be supplied through a supplying nozzle connected to said supplying tube during the lapping or polishing operation.

The direct driving motor of this invention is a motor which transmits the rotation of motor directly to a rotating part of machine without use of a decelerator or a power transmitting means such as belt or chain, and mainly composed by a stator and a rotor. The rotor is directly connected to the driving shaft of the machine and the rotation of rotor is directly transmitted. The direct driving motor does not have it's own frame or housing and is directly built in the machine. Further, since the direct driving motor has a function of rotary encoder, the positioning to control of the platen or carrier head is very easy and accurate.

BRIEF ILLUSTRATION OF THE DRAWING

Figure 2:
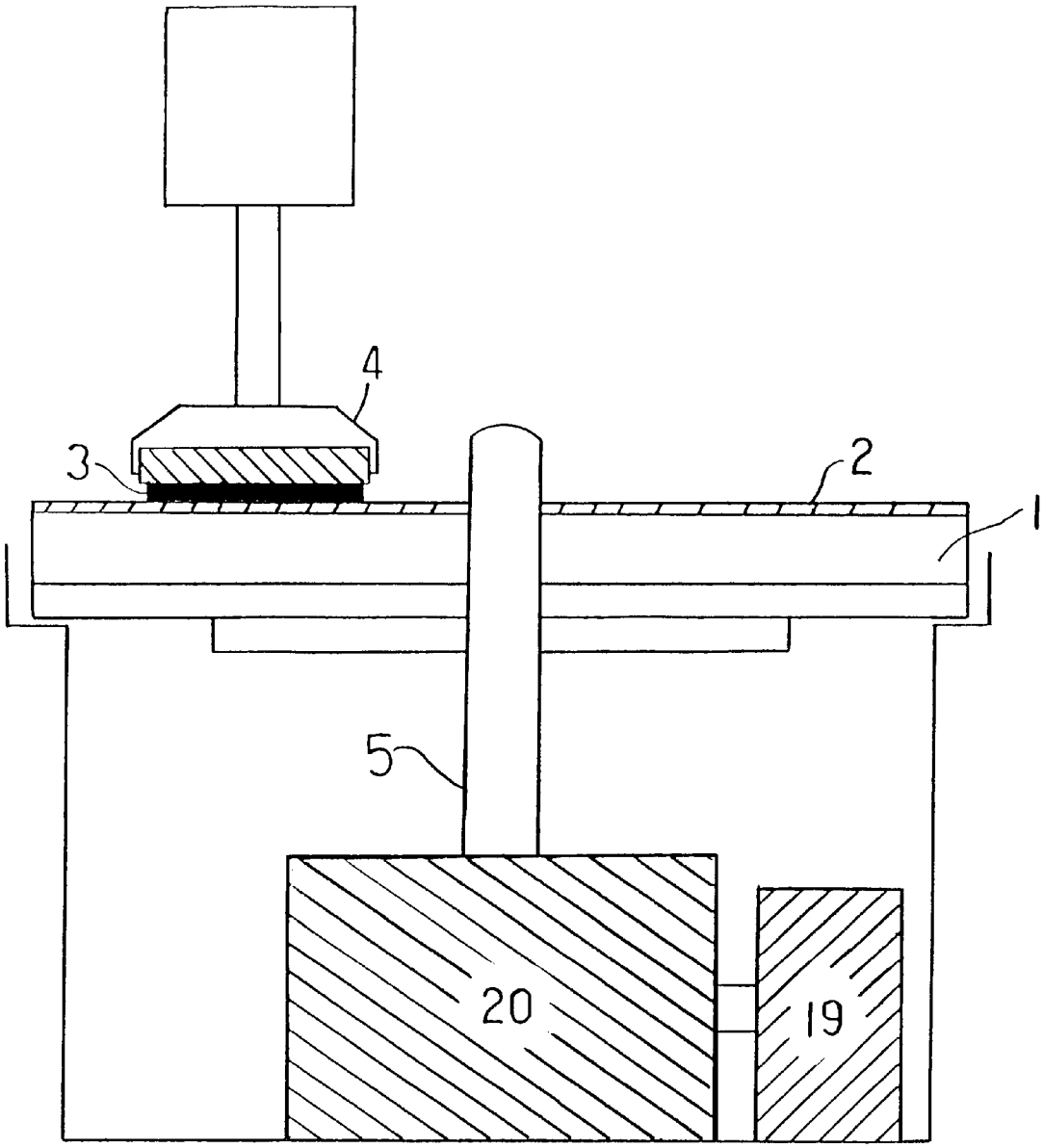

FIG. 1 is a cross sectional view of the polishing machine of this invention with direct driving motor, and FIG. 2 is a cross sectional view of the conventional polishing machine which is furnished with a conventional motor, a reduction gear type decelerator and a power transmitting mean. In the drawing, each numerical mark indicates;

1: platen,
2: polishing pad,
3: work piece,
4: carrier head,
5: driving shaft,
6, 6': direct driving motor,
7, 7': stator,
8, 8': rotor,
9, 9': rotor yoke,
10, 10': encoder,
11: pump,
12: hollow passage
13: nozzle,
14: supplying tube,
15: carrier head cylinder,
16: speed sensor,
17: controller,
18: sticking block,
19: AC motor,
20: decelerator

DETAILED DESCRIPTION OF THE INVENTION

One example of polishing machine of this invention is concretely illustrated by drawings. FIG. 1 is the polishing machine of this invention. In FIG. 1, a platen 1 is connected to a driving shaft 5, and the lower part of driving shaft 5 is connected directly to a direct driving motor 6 (hereinafter shortened to DD motor) and can be driven. That is, to the driving shaft, a rotor yoke 9 is equipped, and the DD motor 6 is composed by said rotor yoke 9, the rotor 8 and a stator 7 which surrounds the rotor 8. Namely, the driving shaft 5 is the driving shaft of platen 1 and, on the other hand, is the driving shaft of DD motor 6. At the lower position of DD motor a rotary type encoder 10 is equipped, which detects the displacement of the shaft and can analyze the position of the platen. In a case of DD motor, since load and power, namely electric current intensity and putout are accurately in proportion, the positioning accuracy is very good, further, the position is accurately detected by the encoder, the positioning accuracy is excellent. The driving shaft 5 is a hollow cylinder, and in the center hollow passage 12, a tube 14 for polishing compound is contained. At another end of the tube, a nozzle 13 for polishing compound supply is connected. Under the platen 1, a speed sensor 16 is attached, and the data from the speed sensor is always fed back to a controller 17, to adjust the rotating speed to the fixed speed, even if there is a change of torque caused by an unexpected change of state.

In FIG. 1, 4 indicates a carrier head, and a work piece 3, e.g. silicon wafer, is stuck and fixed on the lower surface of a sticking block 18. The sticking block 18 is connected to a carrier head cylinder 15, and said cylinder is directly connected to the DD motor 6'. The driving mechanism and controlling mechanism are similar to the mechanism of said platen 1. The work piece 3 is pressed to the polishing pad stuck over the platen, said platen and said carrier head are rotated with constant supply of polishing compound from the nozzle 13, and said work piece is polished by the rotating action. The carrier head 4 can be freely rotated accompanied with the rotation of the platen 1 without compulsory driving. And in FIG. 1, only one carrier plate is shown, however, plural carrier plates can be set up, according to the size of the platen. Further, during the polishing process, the carrier head can oscillate voluntarily on the platen.

The polishing procedure by the polishing machine of this invention indicated by FIG. 1 is illustrated as follows. The work piece 3, e.g. silicon wafer, is fixed to the sticking block 18 of carrier head 4 by wax, and pressed to the polishing pad 2 stuck on the surface of platen 1, by prescribed pressure. The polishing compound is supplied from the nozzle 13, and makes the polishing pad wet sufficiently. Then, the platen 1 and the carrier head 4 are driven to the prescribed direction by the prescribed rotating speed for prescribed time. The polishing pressure and rotating speed can be voluntary changed during the polishing operation. The rotating speed of platen and carrier head are detected by the speed sensor and the detected data is fed back, so as the platen and the carrier head keep the prescribed constant speed, even if other processing conditions, for example, polishing pressure, is changed during the polishing operation. After the prescribed operation time, the polishing machine is stopped, and it is possible to provide a different supplying line and nozzle from the polishing compound supplying line and to supply fresh water for the purpose to wash the polished surface. The position where the platen and the work piece to be stopped can be accurately set up.

FIG. 2 roughly shows the conventional type polishing machine. In the drawing, the platen 1 is driven by a driving AC motor 19. The rotating power of the driving AC motor 19 is transmitted to the driving shaft 5 through the reduction gear type decelerator 20 and drive the platen 1. The size of AC motor 19 and the reduction gear type decelerator 20 are bigger than the size of the DD motor 6 of this invention, and generates heat. In a case of high precision processing, it is necessary to prepare a shelter board made of adiabator (not indicated in the drawing) to prevent the transmittance of generated heat to the platen, or to prepare a quenching ventilator (not indicated in the drawing).

EFFECT OF THE INVENTION

As illustrated in the example of FIG. 1, since the polishing machine of this invention does not need the decelerator and the conveying means of power which a conventional type machine has, the size of machine becomes very compact and light weight. Therefore, the necessary space to set up the machine is narrow and the height of machine is low, and this is a very important merit. That is, even if the machine of the present invention corresponds in output to the conventional large size machine, the machine of this invention is compact and easy handling. Further, in this machine, since it is not necessary to control the temperature raising of the platen caused mainly by reduction gear type decelerator, the equipping of a shelter board or a quenching ventilator are not necessary. And, since the vibration based on the decelerator or power transmitting mechanism is not caused, the machining accuracy and surface roughness can be remarkably improved. Further, the positioning accuracy and of the platen and carrier head is very accurate, it is very useful for the development of an automatic and continuous type machine.

What is claimed is:

1. In a lapping or polishing machine having a rotatable platen and a carrier head for supporting a work piece, said machine being useful for processing a surface of said work piece while the work piece is stuck to said carrier head, by applying frictional force and supplying lapping or polishing compound between a surface of said rotatable platen and the surface of said work piece while said carrier head is pressed to said rotatable platen, the improvement comprising, a direct drive motor connected directly to said rotatable platen, whereby in operation of said machine, the rotatable platen is directly rotatingly driven by said direct drive motor, and, a rotary encoder for controlling the positioning of said rotatable platen.

2. The lapping or polishing machine according to claim 1, which further comprises a direct driving motor directly connected to said carrier head and a rotary encoder for controlling the positioning of said carrier head.

3. The lapping or polishing machine according to claim 1, wherein the direct drive motor for directly driving the rotatable platen comprises a rotating shaft passing through said rotatable platen and having a hollow passage duct located centrally within the rotatable shaft, said machine further comprising a supply tube passing through the hollow passage duct, and a supply nozzle connected to said supply tube and positioned to supply lapping or polishing compound to the surface of the rotatable platen which comes into contact with the said surface of said work piece.

4. In a process for lapping or polishing a surface of a work piece by frictionally engaging said work piece surface in the presence of lapping or polishing compound while said work piece is held by a carrier head of a lapping or polishing machine and pressed against a surface of a rotating rotatable platen, the improvement comprising, directly rotating the rotatable platen with a direct drive motor, and, using a rotary encoder to control the positioning of the rotating rotatable platen.

5. The process for lapping or polishing according to claim 4, further comprising driving the carrier head directly via a direct driving motor and controlling the positioning of the carrier head via a rotary encoder.

6. The process for lapping or polishing according to claim 4, which further comprises supplying the lapping or polishing compound to the platen via a supply tube passing through the platen and a supply nozzle connected to the supply tube and located above the platen.

* * * * *

UNITED STATES PATENT AND TRADEMARK OFFICE

CERTIFICATE OF CORRECTION

Figures 4A, 4B:
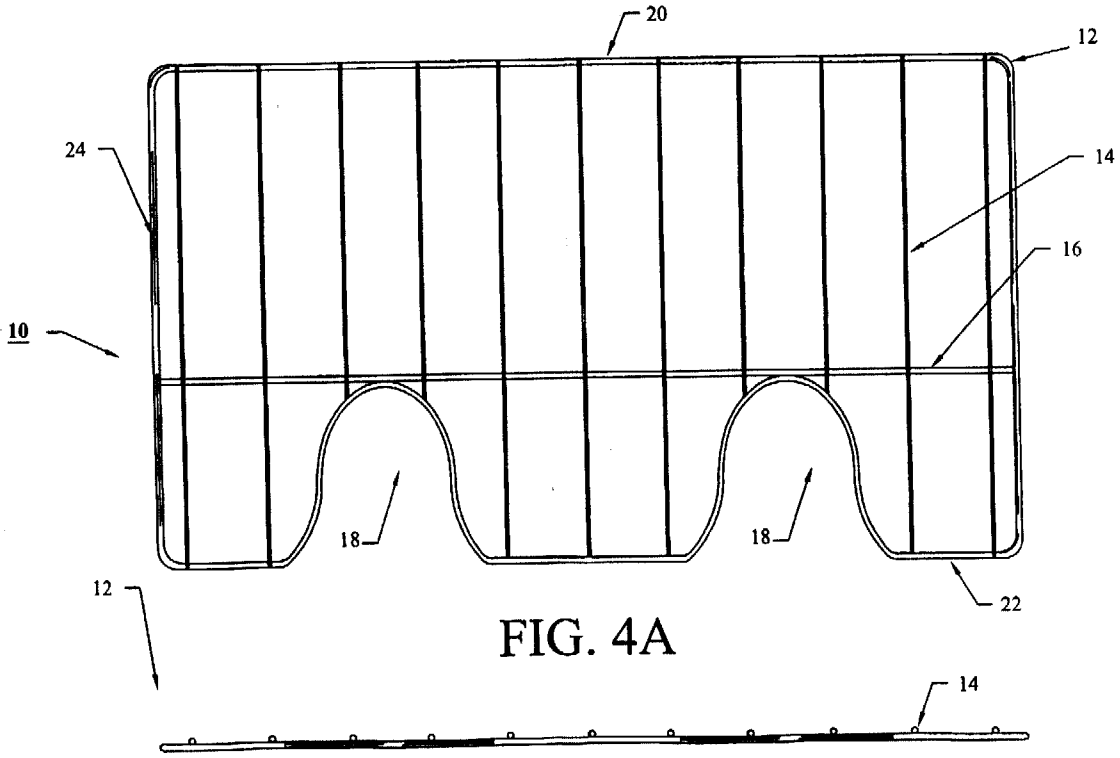

PATENT NO. : 6,250,997 B1
DATED : March 27, 2001
INVENTOR(S) : Robert J. Bartley It is certified that error appears in the above-identified patent and that said Letters Patent is hereby corrected as shown below:

Drawings,
Sheet 4, Figure 4B,
Figures 4A and 4B should be replaced by corrected Figures 4A and 4B.

Signed and Sealed this

Fifth Day of February, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,250,997 B1
DATED : June 26, 2001
INVENTOR(S) : Hatano et al.

It is certified that error appears in the above-identified patent and that said Letters Patent is hereby corrected as shown below:

This certificate supersedes Certificate of Correction issued February 5, 2002, the number was erroneously mentioned and should be deleted since no Certificate of Correction was granted.

Signed and Sealed this

Twelfth Day of March, 2002

*Attest:*

*Attesting Officer*

JAMES E. ROGAN
*Director of the United States Patent and Trademark Office*